US009422069B2

(12) United States Patent
Valicek

(10) Patent No.: US 9,422,069 B2
(45) Date of Patent: Aug. 23, 2016

(54) VAPOR PLATE

(71) Applicant: EMCO WHEATON CORP., Oakville (CA)

(72) Inventor: William W. Valicek, Cypress, TX (US)

(73) Assignee: EMCO WHEATON CORP., Oakville (CA)

( * ) Notice: Subject to any disclaimer, the term of this patent is extended or adjusted under 35 U.S.C. 154(b) by 208 days.

(21) Appl. No.: 13/742,177

(22) Filed: Jan. 15, 2013

(65) Prior Publication Data

US 2014/0196817 A1 Jul. 17, 2014

(51) Int. Cl.

| | |
|---|---|
| ***B65B 3/18*** | (2006.01) |
| ***B65B 57/00*** | (2006.01) |
| ***B65B 1/28*** | (2006.01) |
| *B65D 45/02* | (2006.01) |

(52) U.S. Cl.

CPC ... *B65B 3/18* (2013.01); *B65B 1/28* (2013.01); *B65B 57/005* (2013.01); *B65D 45/025* (2013.01); *Y10T 29/49826* (2015.01)

(58) Field of Classification Search

CPC ..... B65D 45/00; B65D 45/02; B65B 3/18
USPC ..... 137/585, 584, 583; 220/326, 324, 318, 220/367.1; 105/377.11, 394, 358
See application file for complete search history.

(56) References Cited

U.S. PATENT DOCUMENTS

| | | | | | |
|---|---|---|---|---|---|
| 344,473 | A | * | 6/1886 | Bond | E05C 3/042 12/137 |
| 564,251 | A | * | 7/1896 | Long | 220/248 |
| 1,902,731 | A | * | 3/1933 | Sherman | E02D 29/1427 220/210 |
| 2,186,924 | A | * | 1/1940 | Hooper et al. | 137/15.16 |
| 2,693,100 | A | * | 11/1954 | Wiegel | E02D 29/1427 292/64 |
| 3,170,607 | A | * | 2/1965 | Anthon | 222/400.7 |
| 3,874,550 | A | * | 4/1975 | Gordon | 220/213 |
| 4,080,989 | A | * | 3/1978 | Chapelsky et al. | 137/588 |
| 4,132,327 | A | * | 1/1979 | Van Dyke | B65D 45/28 105/377.07 |

(Continued)

FOREIGN PATENT DOCUMENTS

| | | | | |
|---|---|---|---|---|
| FR | 2041383 | * | 1/1971 | 220/367.1 |

OTHER PUBLICATIONS

Drawing showing a prior art construction of a vapor plate coupled to a loading arm; the vapor plate has timed handles and threaded rods: EMCO Wheaton Corp., Dec. 3, 2002 (1pg.).

(Continued)

*Primary Examiner* — John K Fristoe, Jr.
*Assistant Examiner* — Christopher Ballman
(74) *Attorney, Agent, or Firm* — Michael Best & Friedrich LLP

(57) ABSTRACT

A vapor plate for covering a manhole of a cargo transport tanker includes a plate member and one or more push rod assemblies. Each push rod assembly includes a guide tube extending through the plate member and a push rod extending through the guide member. A rod of the push rod moves linearly and rotationally within the guide tube. An adjustable collar of a resistance mechanism may be fixed to the rod so that the collar engages a spring allowing a user to generate a resistive clamping force by pushing downward on the push rod. A user may clamp the rim of a manhole between a lower handle of the push rod and the plate member with the resistive force by positioning the lower handle underneath the rim after generating the resistance force. The push rod assembly is sealed to prevent vapor leakage.

14 Claims, 5 Drawing Sheets

(56) References Cited

U.S. PATENT DOCUMENTS 4,964,755 A * 10/1990 Lewis ..... E02D 29/1409 292/336.3
5,683,123 A * 11/1997 Ruoss ..... E05B 65/1033 292/202
5,775,357 A * 7/1998 Regna et al. ..... 137/43
5,954,095 A * 9/1999 Grigory et al. ..... 138/98
6,073,792 A * 6/2000 Campbell ..... B65D 50/067 220/210
7,320,236 B2 * 1/2008 Monneret ..... E02D 39/1427 292/256
7,377,141 B2 * 5/2008 Javaux ..... E02D 29/1427 292/99
2007/0062584 A1 * 3/2007 Prahl et al. ..... 137/588
2007/0081856 A1 * 4/2007 DeGreef ..... E02D 29/1427 404/25

OTHER PUBLICATIONS

Picture showing a prior art construction of a vapor plate using a threaded rod with handle: EMCO Wheaton Corp., date unknown, admitted prior art (1pg.).

* cited by examiner 44a
50
48

10
3
3
44
48
14
66
68
70
52'
64
54
30
12
28
24
26
32
42
46
22"
18
22'''
22'
24'
100
102
62
60
58
56
52

VAPOR PLATE

CROSS-REFERENCE TO RELATED APPLICATIONS

None.

BACKGROUND OF THE INVENTION

1. Field of the Invention

The present invention is in the field of vapor plates used to cover manholes of transport tankers, such as an over-the-road tank trailer and tank railcars.

2. Description of Related Art

Vapor plates are utilized to cover the manhole of a tanker trailer or railcar when filling the tanker with the desired cargo. Commonly transported liquid cargo may be volatile and/or hazardous, such as liquid propane, gasoline, oil, liquefied natural gas, asphalt, industrial chemicals or acids. Other liquid cargo may not be hazardous, but may require maintaining sanitary conditions, such as milk, vegetable oils, other food oils, juices, or other items. Further, many dry goods which are commonly transported in such tankers may create a fine dust which may cause respiratory problems for workers when filling the tanks up with the dry cargo. A vapor plate plays an important role in keeping the volatile or hazardous gases in the tank or, alternatively, the un-sanitized airborne contaminants out.

Particularly, as used in the petroleum and chemical industries, the vapor plate keeps the gasoline or chemical vapors within the tank and may also prevent the build-up of excess vapor by allowing vapor removal using a vapor recovery system. Keeping the vapor from escaping the tank through the vapor plate is important for at least the following reasons: (1) the health of the operator, (2) environmental protection, (3) general safety (for example preventing build-up of flammable gases), and (4) satisfying industrial or governmental regulations. In other industries, vapor plates may also be important for protecting the safety of the food supply.

However, given the importance of keeping vapors in or contaminants out of the tanker in view of the harmful effects listed above, existing vapor plates have continually been found to perform insufficiently over their functioning lives. Existing vapor plates can generally comprise a plate having threaded rods extending through which are threadably engaged to the plate. The threaded rods generally have an appendage at the bottom of the threaded rod that can be raised and lowered to engage and release the appendage against the bottom of a rim of a manhole on a tank trailer or railcar. The appendage is raised and lowered by a user generally turning a handle at the top of the threaded rod and adjusting a threaded collar.

Threaded rods can be made of softer steel than many other steel components in order to economically manufacture a tooled threaded rod. The softer material can result in the threaded rod bending at some point during its functional life, particularly early on. Any bending of the threaded rod negatively impacts the function and performance of the vapor plate. The threaded push rod also has other shortcomings. As the threaded rod repeatedly passes through the threads in the existing vapor plate, any protective coating on the material wears off resulting in corrosion of the threads which results in the loss of material. In addition, if the collar is even a slightly different steel grade than the threaded rod, with either a higher or lower strength, the threads in the collar or on the threaded rod can wear down, again resulting in a loss of material. Further, the bending of the rod alters the thread distance at the bend. These frequently occurring losses of material or changes in the thread distance can create a passageway for vapors or gas to leak through the threads and vapor plate out of, or into, the tank.

SUMMARY OF THE INVENTION

The present invention is directed to a vapor plate for covering a manhole of a cargo transport tanker while the tank is being filled. The vapor plate comprises a plate member and a plurality of push rod assemblies operably connected to the plate member. The plate member may have a sealing member adhered to a portion thereof. Each of said plurality of push rod assemblies includes a guide tube extending through said plate member and coupled thereto, a push rod journaled for linear and rotational travel within said guide tube, and a resistance mechanism coupled to the push rod. Each push rod includes handles coupled to a respective end of a rod of said push rod. The resistance mechanism includes a spring and a collar. The guide tube includes a tube, an upper ring plate at one end of the tube and a lower ring plate at another end of the tube.

The spring is positioned between said collar and said upper ring plate. A position of said collar is adjustable along a length of said rod of said push rod. The collar is fixed along the rod to a selected position such that the spring resists linear travel of said push rod relative to said guide tube. O-rings are positioned within said upper and lower ring plates of said guide tube to engage said rod thereby forming a substantially gas-resistant seal between said guide tube and said rod of said push rod.

In use, the vapor plate is used to seal a manhole of a cargo tanker while filling the tanker carrying liquid or dry cargo. In one embodiment, to install the vapor plate on the manhole, top handles of the push rods are rotated so the handle extends radially inward. Since the lower handle is timed with said top handle, rotating the top handle results in both handles facing radially inward. The vapor plate may be then placed on top of a rim of the manhole of the tanker because the lower handles are turned inward and will not catch on the top of the manhole rim. Next the top handle of the push rod is rotated so that the top and lower handles extend radially outward so that the lower handle extends radially further outward than the bottom edge of the manhole rim. Next, the top handle is pulled upward until the lower handle locates and contacts with the bottom edge of the manhole rim. Next, the top handle is again rotated so that the lower handle points radially inward and is no longer is in contact with the bottom edge of the manhole rim. The top handle is pulled slightly upward a distance to position the lower handle a distance above the bottom edge of the bottom edge of the manhole rim. Next, the collar is locked and fixed in position on the rod. The collar is fixed on the rod so that the collar bears against the spring. The spring also bears against the guide tube. The process is repeated for all push rod assemblies.

A user then applies a substantially linearly downward force on the top handle of the push rod until the lower handle is below the bottom edge of the rim. The user again rotates the top handle so that the lower handle extends substantially radially outward and under the rim of the manhole. Once the lower handle is in place, the user gradually reduces the downward force applied on the top handle until said lower handle contacts said bottom edge of said rim. The user then stops applying the downward force resulting in the manhole rim being clamped between the plate and the lower handle of the vapor plate with the resistance force generated by the displacement of the collar against the spring. The process is repeated for all push rod assemblies Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
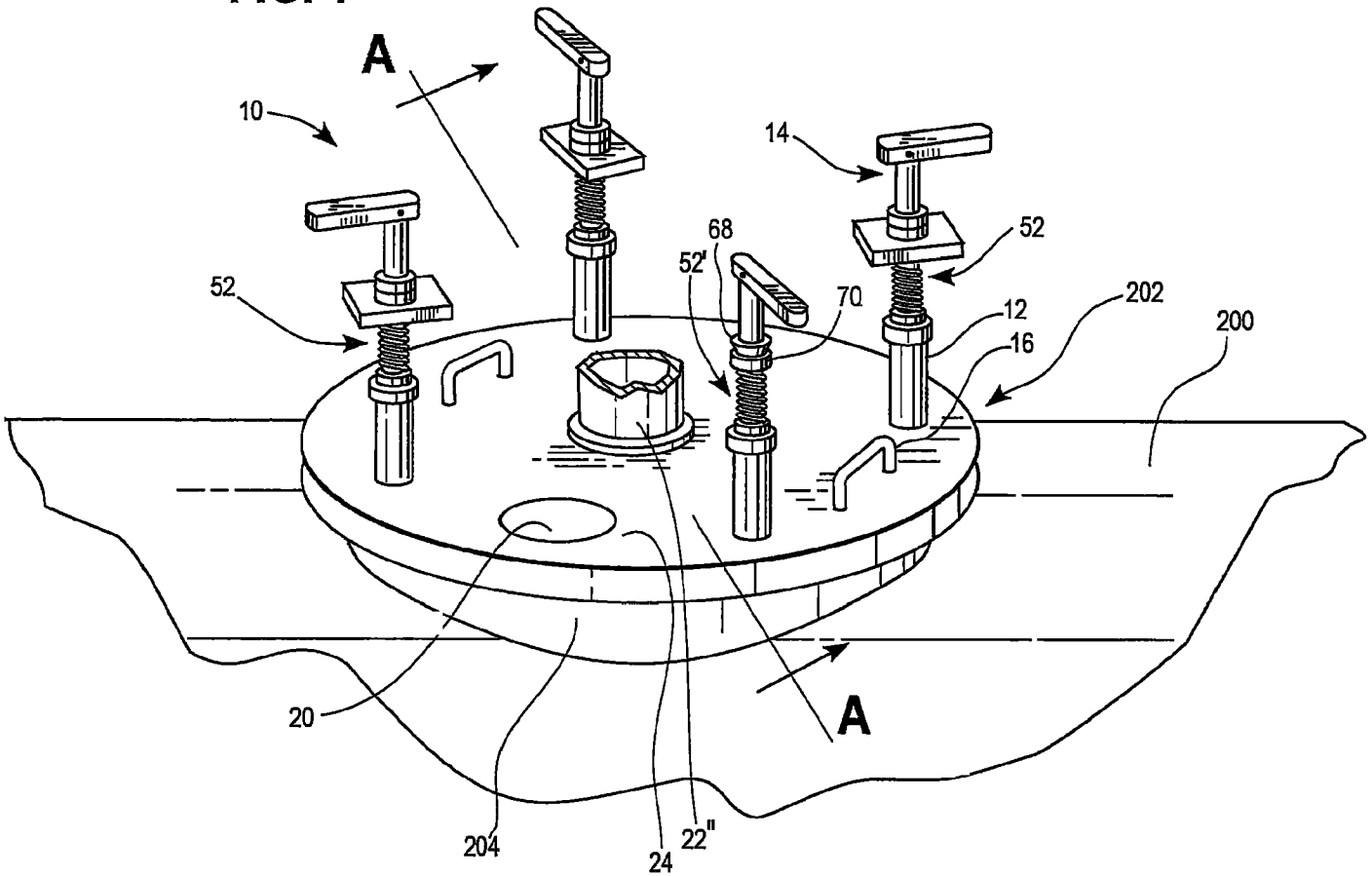
FIG. 1 is a schematic perspective view of one embodiment of a vapor plate in accordance with the teachings of the present invention installed on a manhole of a tanker.

As illustrated in FIG. 1, the present invention is directed toward a vapor plate 10 having an improved mechanism for coupling vapor plate 10 to a manhole 202 of a fluid or dry goods transport tanker 200 such as an over-the-road or railroad tanker to transport liquid or dry cargo. Examples of liquid cargo include gasoline, oil, asphalt, chemicals, acids, milk, other food products, or any other liquid now known or hereafter known to be conveyed using bulk transport tankers. Examples of dry cargo includes grain, grain flour, chemical granules, powdered milk, or any other dry cargo now known or hereafter known to be conveyed using bulk transport tankers. Vapor plate 10 includes a plate 24, guide tubes 12, push rods 14 passing through said plate 24, resistance mechanisms 52 coupled to push rods 14, at least one handle 16 coupled to plate 24, and a cargo passage 18 through said plate 24. A portion 22' of a loading arm, which can also be called a supply pipe, passes through the hole 18. Also a portion of the loading arm 22" is above plate 24 and includes a flange or coupling, in the form of a flange or collar 22'". The loading arm portion, by way of the flange 22'", is fixedly coupled to a part of the plate 24 adjacent the wall 24' forming the passage 18. The portions of the loading arm 22', 22", and 22'" can be called a loading arm coupling or supply pipe coupling. The loading arm coupling can be continuous with and an integral part of the loading arm portion upstream of the loading arm coupling. It can also be a separate piece which couples to another upstream portion of the loading arm. When the vapor plate 10 is installed on the tank 200, the cargo is discharged from the loading arm portion 22' extending through the plate 24 and into tank 200. The cargo passes through hole 18. Flange 22'" may be welded to plate 24. Alternatively, flange bolts (not shown) may be welded to the top of plate 24 and the flange may be connected to plate 24 by these bolts. These alternatives are used so that there are no mounting holes through plate 24 which provide the opportunity for vapor to escape. However, any method of coupling a loading arm, which can also be called a supply pipe, to vapor plate now known or hereafter developed may be utilized. Vapor plate 10 may also include a vapor recovery opening 20 through plate 24. A vapor recovery assembly to remove any harmful vapor build-up in the tanker while filling the tanker 200 could then be connected to the plate 24 at opening 20.

Figures 2A, 2B:
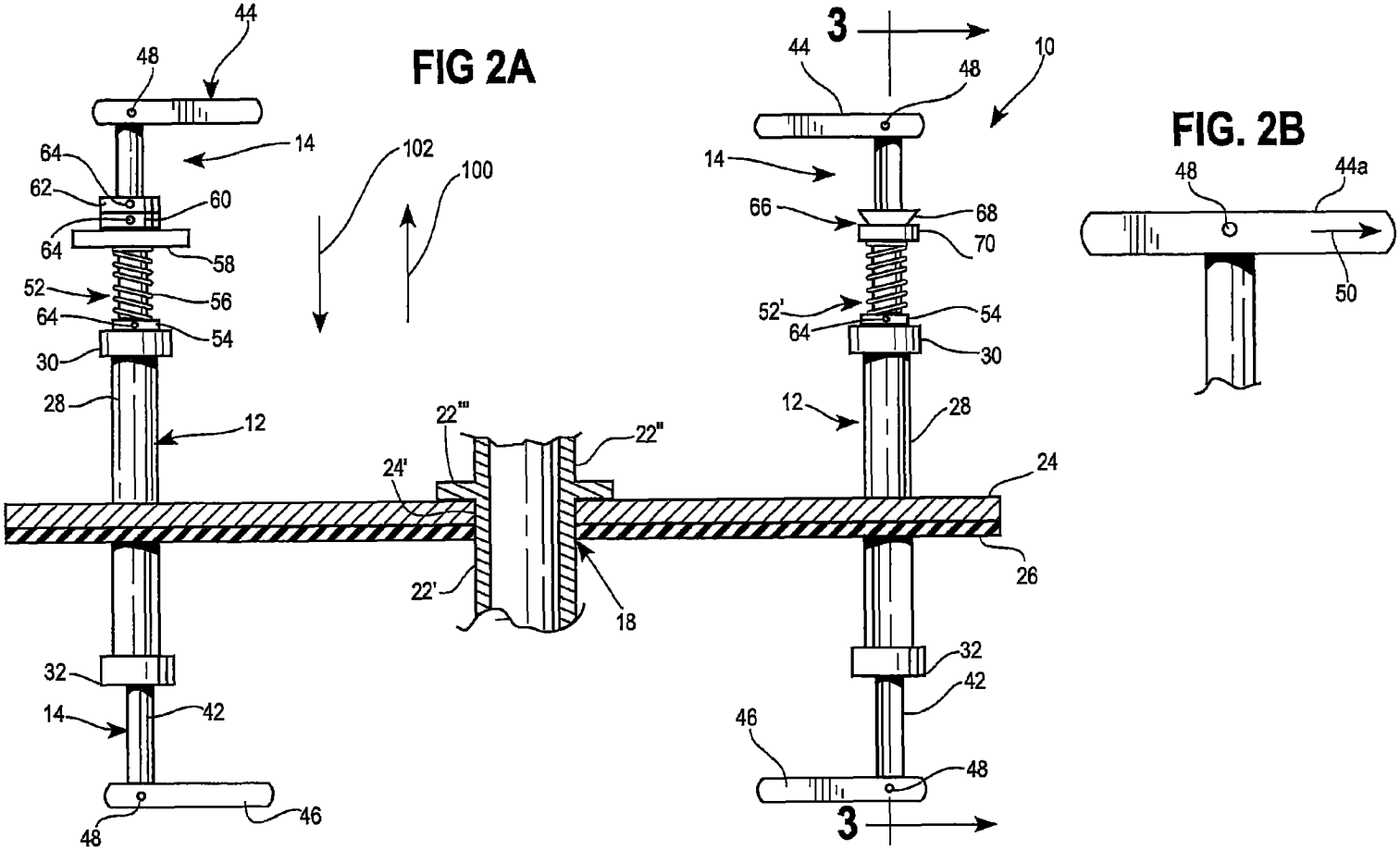
FIG. 2*a* is a side view of one embodiment of the vapor plate shown in FIG. 1 taken along view lines A-A in accordance with the teachings of the present invention; in contrast to FIG. 1, the handles of the push rods are shown as rotated inward which is where they are located when the vapor plate is initially set on the manhole but prior to being installed; set screws intentionally omitted from FIG. 1 are shown in FIG. 2*a* to further illustrate the invention; the manhole and tanker shown in FIG. 1 have been intentionally omitted from FIG. 2*a;*
FIG. 2*b* is a close up of an alternative of a type of upper handle used with a rod of a push rod of the present invention.

FIG. 2*a* illustrates a side sectional view of vapor plate 10. Vapor plate 10 has plate 24 and sealing member 26. Sealing member 26 can be considered a component of plate 24. Plate 24 may be any thickness known in the art. However, plate 24 is preferably in a range depending on the application. For instance, between one-eighth and one inch (⅛"-1"), for some applications is acceptable. Plate 24 may be steel, aluminum, or any other material now known or hereafter developed. Handle 16 is coupled to plate 24 using any method now known or hereafter developed. However, handle 16 is preferably welded so as to not introduce any additional holes through plate 24. Sealing member 26 is adhered to a bottom surface of plate 24 and may be elastic or a viscoelastic material such as neoprene, closed cell foam, rubber, polymer, or any other material now known or hereafter developed.

FIG. 2*a* further shows guide tubes 12. Each guide tube 12 comprises pipe or tube sections 28, upper ring plates 30, and lower ring plates 32, wherein the upper and lower ring plates 30 and 32 of each tube 12 may be coupled to each tube's respective pipe section 28. The pipe section can also be called a tube section or tube or pipe 28. Any mechanical or chemical coupling method now known or hereafter developed may be utilized, including threaded connection, welding, adhesives, or a mechanical fastener to couple each tube 28 to its respective upper 30 and lower 32 ring plates. The guide tubes 12 are each the same.

Figure 3:
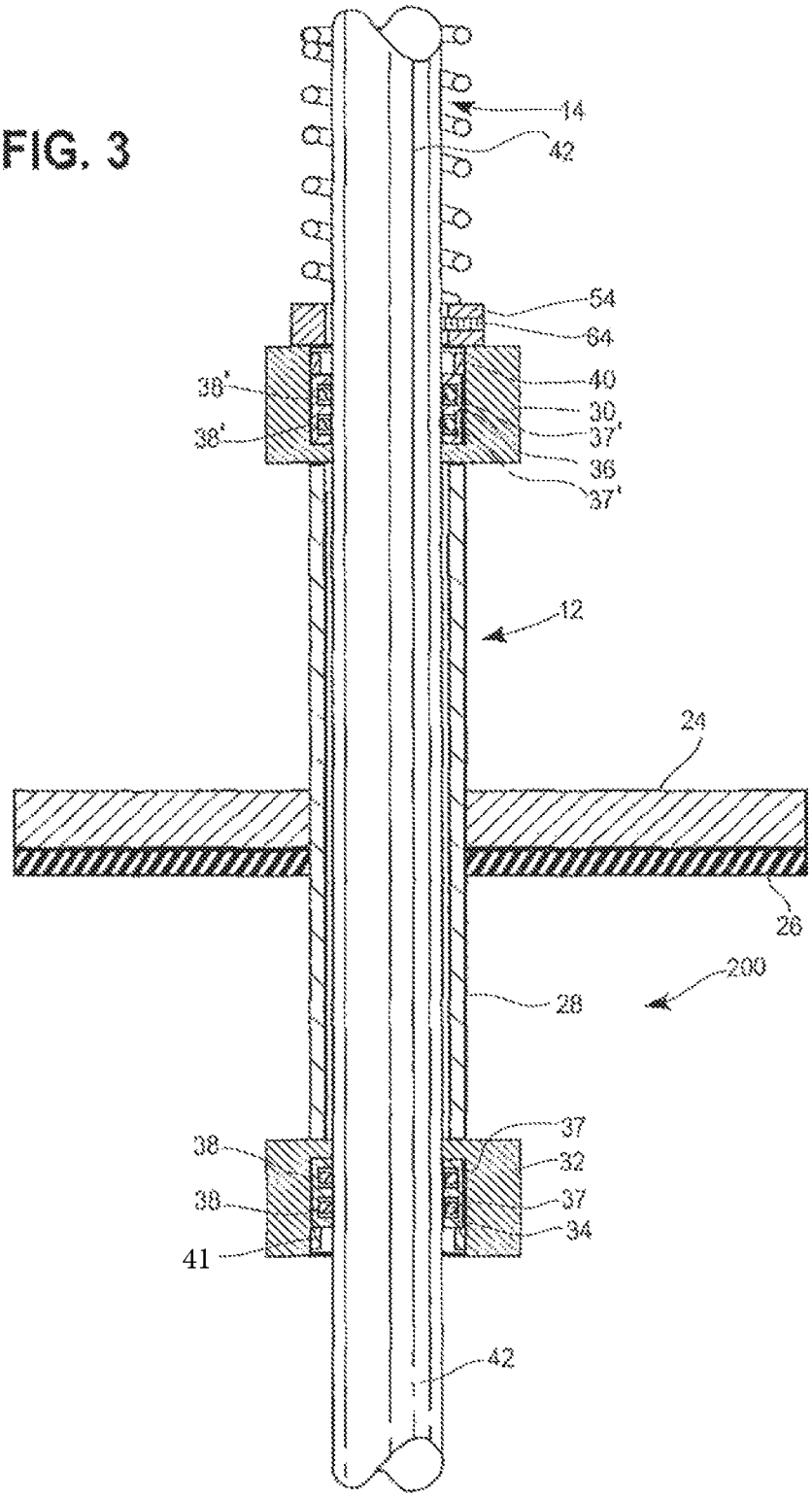
FIG. 3 is a cross-sectional view of the guide tube and push rod assembly of the embodiment of the present vapor plate of FIG. 2*a* along the line 3-3.

FIG. 3 is a sectional view through one of the guide tubes 12 that illustrates lower ring plate 32 and upper ring plate 30. The lower ring plate 32 includes a bushing 34 housed in a hollow portion of the plate. The bushing can be made of metal such as steel or brass. The bushing 34 includes grooves 37 each which house an O-ring 38. As further shown in FIG. 3, upper ring plate 30 comprises a bushing 36 housed in a hollow portion of the ring plate 30. The bushing includes grooves 37', each housing at least one O-ring 38'. The constructions of ring plates 30, 32 seal out vapors from entering or escaping through guide tubes 12. The bushings 34, 36 may be sleeve bearings with grooves 37, 37' and O-rings 38, 38'. Further, guide tube 12 may include a wiper 40 disposed in one or more of ring plate 30 and 32 as shown in FIG. 3. The wiper 40 can be considered a component of its respective ring plate 30, 32. Guide tube 12 and its components may be any material including steel, aluminum, brass, carbon fiber, polymer, any combination thereof, or any other now known or hereafter developed. Each tube 12 extends through a respective hole of the plate 24 and is fixed and connected to a respective portion of plate 24. In more detail, the pipes 28 of guide tubes 12 each extend through one of the respective holes of plate 12. Each pipe 28 is fixed to the plate. A weld normally fixes each pipe 28 to the plate 24.

In FIG. 2*a*, push rods 14 are shown. FIG. 2*a* shows two push rods 14. Each push rod 14 includes a rod 42, a top handle 44, and a lower handle 46. Rod 42 may be any length which provides the necessary adjustment to be used in a variety of manholes. For example, manhole 202 may have a rim 204 of various heights or axial lengths. Accordingly, a push rod 14 may have a length of rod 42 for use with one particular height of rim 204 if one certain type of tank is continually used. However, vapor plate 10 will have the widest application if rod 42 has a length that can accommodate rims 204 of varying and commonly experienced heights. Each end of rod 42 is coupled to handle 44 and 46, respectively, using any coupling method known in the art wherein the handles 44 and 46 are timed. Having timed handles means that the handles 44, 46 coupled to a rod 42 face in the same direction, preferably the exact same direction, at all times as shown. Each handle 44 and 46 may be secured in this "timed" position using a pin 48. In one embodiment, each end of rod 42 is threaded to respective handles 44 and 46. Each handle has a threaded socket to receive the respective end of rod 42 for coupling handles 44 and 46 to rod 42.

Handles 44 and 46 may extend in one direction away from rod 42. Alternatively, one embodiment of top handle 44*a* shown in FIG. 2*b* includes a "T" handle, wherein handle 44*a* would include an indicator 50, such as the arrow shown, to indicate to a user the direction in which the timed lower handle 46 points. Lower handle 46 may include a friction-increasing material (not shown), such as rubber or a viscoelastic polymer, disposed on the face that engages rim 204.

As shown in FIG. 2*a*, resistance mechanisms 52, 52' provide a resistance and clamping force. The mechanisms 52, 52' resist the linear translation of push rod 14 relative to guide tube 12 when resistance mechanisms 52, 52' are fixed at a position along the length of the rods 42. One embodiment of resistance mechanism 52 shown with rod 14 on the left of the page includes a bearing collar 54, a spring 56, a handle nut 58, a first collar 60, and a second collar 62 wherein first collar 60 and second collar 62 may be secured to rod 42 at a position along its length using a set screw 64. Bearing collar 54 can also have a set screw 64. An alternative resistance mechanism 52' is shown in FIG. 2*a* on the right of the page with rod 14. The mechanism 52' includes a clamp 66 in place of the first and second collars 60, 62. Clamp 66 may be any pipe clamp now known or hereafter developed including a slide clamp, a cam clamp, a quick-release pipe clamp, or any other known pipe clamp. In the embodiment shown, the clamp 66 operates by pulling an upper portion 68 away from a lower portion 70 which disengages the circumferential clamping force applied to the rod and allows the position of clamp 66 to be adjusted along the length of rod 42. Clamp 66 may include a contact material configured to contact the surface of rod 42 to increase the frictional force provided to resist movement of clamp 66 relative to rod 42 as known in the art.

Push rods 14 and their components may be constructed from any material including steel, aluminum, brass, carbon fiber, or polymer or any other material now known or hereafter developed. One embodiment includes rod 42 being 1144 carbon steel that is chromed for surface protection and/or reduction of friction.

Spring 56 of mechanisms 52, 52' is operable to exert an upward 100 force on rod 42 when collars 60 and 62 or clamp 66 are fixed to rod 42 and a user applies a downward 102 force on push rod 14 compressing spring 56 against guide tube 12. Spring 56 may be any type of spring now known or hereafter developed including viscoelastic or elastic bands or bushings or any other compression resistance spring now known or hereafter developed. Upward is in a direction 100 away from and out the manhole 202. Downward 102 is in a direction into the manhole 202 of tank 200.

One beneficial feature of the present vapor plate 10 is that it is configured to significantly reduce the amount of vapor that escapes through the openings in plate 24 that accommodate the passage of push rods 14 and guide tubes 12. This beneficial configuration of the push rods 14 and guide tubes 12 in the present vapor plate 10 is best illustrated in FIG. 3. FIG. 3 shows a push rod 14. As shown, rod 42 of push rod 14 passes through upper ring plate 30, pipe section 28, and lower ring plate 32 of guide tube 12. Rod 42 passes through upper wiper 40 housed in upper ring plate 30 wherein wiper 40 is an elastic rubber or polymer ring which constricts slightly around rod 42 to prevent debris from entering into guide tube 12 and interfering with the movement of rod 42 relative to guide tube 12. Wiper 40 does not impede rod 42 from rotating or linearly translating within guide tube 12. Upper ring plate 30 may also include bushing 36 which includes one or more grooves 37' housing one or more O-rings 38' as shown. O-rings 38' are generally rubber or another smooth viscoelastic polymer which again allow rod 42 to rotate or linearly translate within guide tube 12, but create a substantially liquid and/or gas-resistant seal between rod 42 and guide tube 12 thereby substantially preventing vapor from passing through guide tube 12 into or out of tank 200.

The space between rod 42 and pipe section 28 may be empty or may be packed with grease or other lubricant to facilitate the movement of rod 42 therewithin. Rod 42 also passes through a bottom end of pipe section 28 and lower ring plate 32. Lower ring plate 32 may include bushing 34 inserted therein. Wherein rod 42 is inserted through bushing 34 such that bushing 34 allows linear and rotational displacement of rod 42 in relation to lower ring plate 32. Bushing 34 may also be configured to provide a liquid or gas-resistant seal as known in the art such as grooves 37 and 0-rings 38 which are the same or different from grooves 37' and 0-rings 38'. As further shown in FIG. 3, rod 42 extends through a lower wiper 41 which is the same as upper wiper 40 and also helps prevent debris from entering the guide tube 12 and interfering with the movement of rod 42 therein.

In the embodiment illustrated in FIG. 1, vapor plate 10 includes four guide tubes 12 and push rods 14 to secure it to a manhole 202. The resistance mechanisms 52, 52' could all have the same construction. Alternatively some of the mechanisms can have the construction of mechanism 52 and some the construction of mechanism 52'. A guide tube 12 combined with a push rod 14 and a resistance mechanism 52, 52' can be called a push rod assembly. Depending upon the size of the manhole 202, vapor plate 10 may include any number of guide tubes 12 and push rods 14 as necessary to secure vapor plate 10 to rim 204 of manhole 202 and provide the adequate clamping force to hold vapor plate 10 in place on rim 204. Further, the spacing of guide tubes 12 and push rods 14 should be sufficient such that plate 24 of a known thickness does not bend between the supports provided by the guide tubes 12 and push rods 14. The determination of the necessary spacing is well known to a person of skill in the art.

Figure 4:
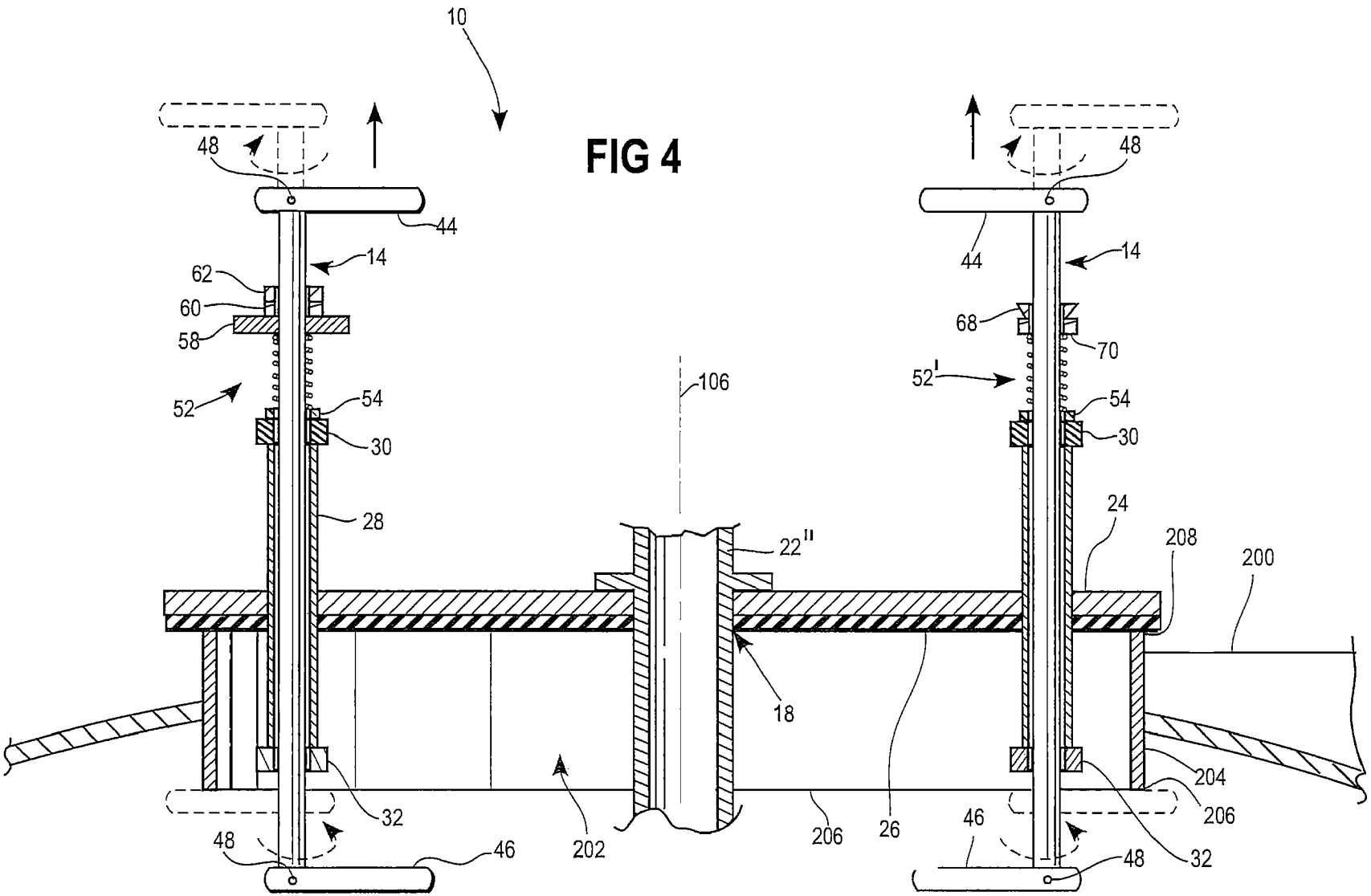
FIG. 4 is a cross-sectional view of the embodiment of the present vapor plate of FIG. 1 taken along a view line similar to view line A-A; the view line has been modified to section through the guide tubes and resistance mechanisms shown in FIG. 1 which are the same as those shown in FIG. 2*a* accept the set screws are intentionally omitted from the section; the handles of the push rods, like in FIG. 2*a* are shown as rotated inward which is where they are located when the vapor plate is initially set on the manhole but prior to being installed.

In use, an embodiment of vapor plate 10 is inserted into manhole 202 of tank 200 such that plate 24 of vapor plate 10 bears on a top edge 208 of manhole rim 204. The portion of plate 24 that bears upon rim 205 is seal 26. As shown in FIG. 4, to facilitate inserting the components of vapor plate 10 into the manhole 202, top handle 44 and lower handle 46 of push rods 14 are turned inwardly. Inwardly is relative to the central axis or portion 106 of plate 24. Inward is more toward the central portion 106 than away from the central portion. When moved inwardly, the push rods 14 can be generally in a linear position below plate 24 such that lower handle 46 will be below a bottom edge 206 of rim 204. As shown, sealing member 26 generally deforms under the weight of vapor plate 10 when plate 24 is set upon top edge 208 rim 204 of manhole 202. The deformation of sealing member 26 may create a substantially liquid or gas-tight seal between manhole rim 204 and plate 24. After the inward handles are below bottom edge 206, a user next rotates each top handle 44 until it points substantially radially outward from a center or axis 106 of plate 24. A user then pulls a handle 44 upwardly in direction 100 so that rod 42 linearly translates, along its longitudinal axis, with respect to guide tube 12 and thereby draws lower handle 46 into contact with bottom edge 206 of rim 204 as shown in dashed lines in FIG. 5. This step allows a user to locate bottom edge 206 of rim 204. Outwardly is relative to the central axis or portion 106 of plate 24. Outward is more away from the central portion 106 than toward the central portion. A user may have to release collars 60 and 62 or clamp 66 during one or more of the above rotating or sliding steps above as needed to allow rod 42 to slide relative thereto depending upon the type of collars or clamps being used.

Figure 5:
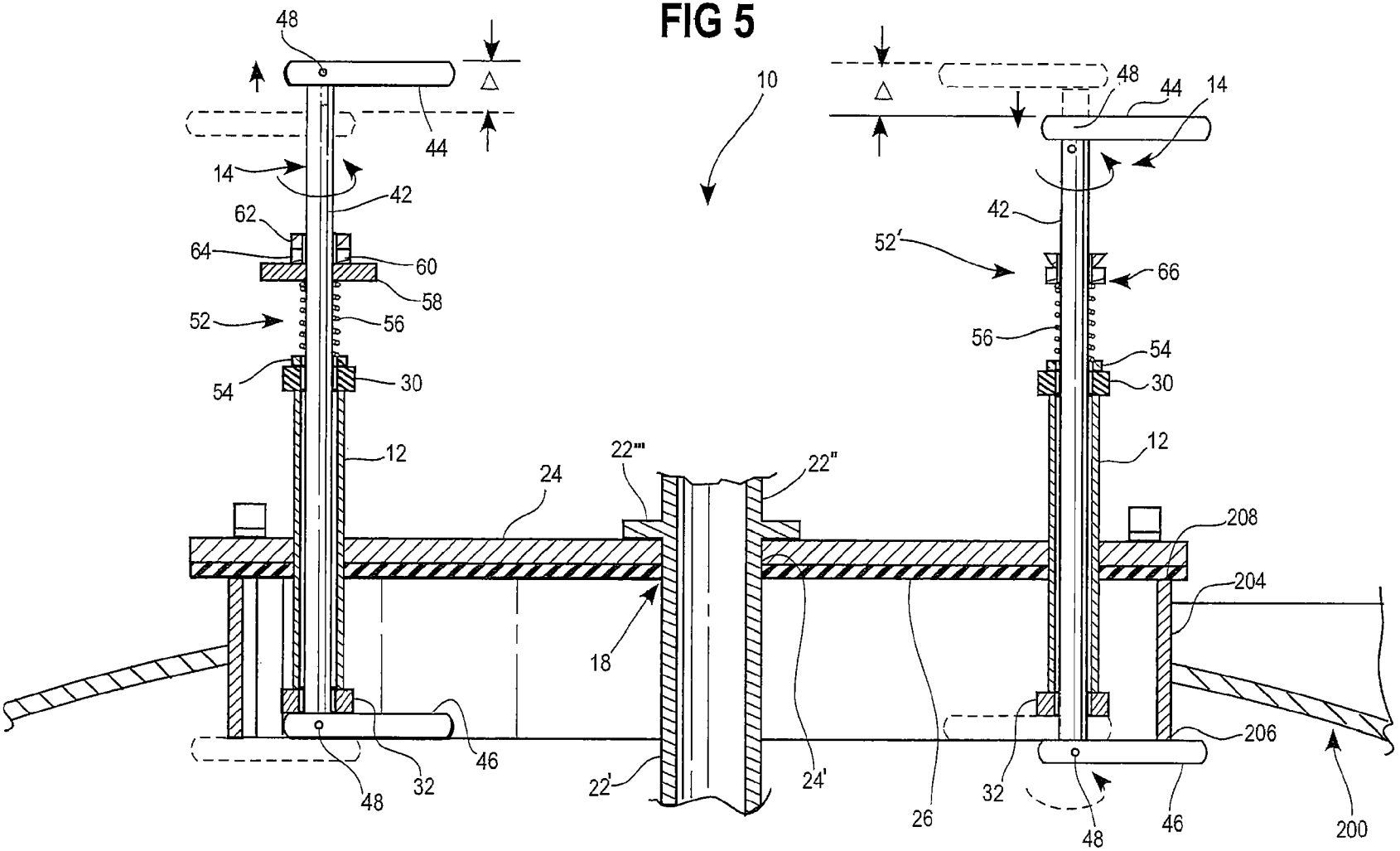
FIG. 5 is the cross-sectional view shown in FIG. 4 at another point during the installation process.

Now further referring to FIG. 5, illustrations of the next step of installation are provided. Once the user has located bottom edge 206 of rim 204, the user again turns top handle 44 of the rod 14 so that lower handle 46 of rod 14 is pointed inwardly toward center portion 106. The user displaces push rod 14 upward in direction 100 a distance Δ by moving top handle 44 of rod in an upward direction 100. Once a rod 14 is at this point, the user fixes the position of first and second collars 60 and 62 with respect to rod 42 of push rod 14, if mechanism 52 is involved, by tightening set screws 64. If mechanism 52' is involved, the user fixes the position of clamp 66 relative to rod 42 of push rod 14 by clamping clamp 66 in a fixed position. The collars or clamps are thus fixed with respect to rod 142 so the rod does not move relative to its respective collar or clamp. The collars 60 and 62 or clamp 66 should be resting against their respective spring 56 when fixed in position on rod 42. If a handle nut 58 or the like is used than they should be resting against member 58 which in turn rests against spring 56. Thus, any displacement of the push rod 14 downward in direction 102 encounters a resistance force in direction 100 from spring 56 of resistance mechanism 52, 52'. For example, applying a downward force to handle 44 would engage collars 60 and 62 against spring 56 and any displacement of spring 56 downward in direction 102 results in the spring applying an upward resistance force in direction 100. In one embodiment, spring 56 of resistance element 52 provides a resistance force of around seventy pounds per inch of displacement. The above procedure is repeated for every push rod assembly so the lower handles 46 of each rod 14 are set to the distance above the bottom edge 206 of rim 204.

Having set collars 60, 62 or clamp 66 of the push rods 14, next, as shown in FIG. 5, the user will push down on a handle 44 against the resistance of a spring 56 of resistance mechanisms 52, 52' such that lower handle 46 of a rod 14 is again below bottom edge 206 of rim 204. At this time, the user rotates top handle 44 while maintaining the downward force applied thereto so that handle 44 again points substantially radially outward from center 106. This motion also orients lower handle 46 to also point substantially radially outward. The user then releases the downward force on handle 44. As a result of the release, resistance element 52, 52' by way of spring 56, pushes and moves push rod 14 upwardly such that lower handle 46 engages bottom edge 206 of rim 204 as shown. The engagement applies a compressive force between lower handle 46 and sealing member 26 of plate 24. The above process is repeated for all push rod assemblies coupled to the plate 24. The plate 24 is compressed against top edge 208 of rim 204 thereby securing vapor plate 10 to manhole 202. The clamping force applied may result in additional displacement of sealing member 26 adding to or perfecting the vapor-resistant seal.

The clamping force applied is substantially equal to the resistance force multiplied by the displacement distance Δ. For example if Δ equals two inches and the resistance force equals seventy pounds per inch, then the force applied to displace push rod 14 such that the lower handle 46 is below rim 204 is at least one-hundred forty (140) pounds. Similarly, the clamping force applied by the resistance mechanism 52 which effectively clamps the rim between plate 24 and handle 46 is also one-hundred forty (140) pounds. Thus, the clamping force applied can be easily adjusted by a user by increasing or decreasing Δ, and/or using springs 56 with a higher or lower spring resistance force.

Vapor plate 10 can be removed simply by pushing down on each push rod 14. Pushing down on the rods disengages the lower handles 46 from rim 204. The handle 44 is then turned radially inward toward axis 106. Further, the removal process may be shortened in some embodiments by simply disengaging the resistance mechanism 52 by untightening the set screws 64 of collars 60 and 62, or releasing clamp 66 from rod 42 so that the resistance mechanism 52' no longer exerts any force upon push rod 14.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

I claim:

1. A vapor plate for covering a manhole of a cargo transport tanker, the vapor plate comprising:

a plate member having a cargo passage opening; and one or more push rod assemblies, each of said one or more push rod assemblies movable between an engaged position and a disengaged position, the push rod assemblies each comprising:

a guide tube extending through said plate member and coupled thereto;

a push rod journaled for linear and rotational travel within said guide tube;

a resistance mechanism coupled to said push rod and having a portion adjustable between a first position and a second position along the push rod, wherein when adjusted to the first position with the push rod assembly in the engaged position, the resistance mechanism provides a first level of resistance and when adjusted to the second position with the push rod assembly in the engaged position, the resistance mechanism provides a second level of resistance that is greater than the first level of resistance; and a seal disposed between said guide tube and said push rod.

2. The vapor plate of claim 1 wherein said plate member further includes a sealing member.

3. The vapor plate of claim 1 wherein said guide tube comprises a tube section, an upper ring plate, and a lower ring plate, wherein one of said upper ring plate and said lower ring plate includes a bushing that carries one or more O-rings, and wherein said seal comprises said one or more O-rings engaging said push rod.

4. The vapor plate of claim 3 wherein said push rod includes a rod, a top handle, and a lower handle, wherein said top and lower handles are fixed with respect to one another.

5. The vapor plate of claim 1 wherein said resistance mechanism comprises a spring.

6. The vapor plate of claim 1 wherein said portion of said resistance mechanism is movable between an unfixed position and a fixed position, and wherein when said portion is unfixed, said mechanism is disabled from being loaded with force to clamp said plate.

7. The vapor plate of claim 6 wherein said mechanism and a length of said rod enable securement of said vapor plate to rims having different heights with a same clamping force.

8. The vapor plate of claim 6 wherein said portion is selectively fixable in a position along a length of said push rod.

9. The vapor plate of claim 1 further comprising a supply pipe coupling connected to said plate, said supply pipe coupling being in fluid communication with said cargo passage opening.

10. The vapor plate of claim 1 further comprising a vapor recovery opening in said plate.

11. A vapor plate for covering a manhole of a cargo transport tanker, the vapor plate comprising:

a plate member having a sealing member adhered thereto;

a plurality of push rod assemblies, each of said plurality of push rod assemblies comprising:

a guide tube extending through said plate member and coupled thereto, said guide tube comprising a tube section, an upper ring plate, and a lower ring plate, wherein one of said upper ring plate and said lower ring plate includes a bushing that houses one or more O-rings;

a push rod including a rod having a length, a top handle, a lower handle, said rod journaled for linear and rotational travel within said guide tube, said handles coupled to respective ends of said rod, said handles being fixed with respect to one another;

a spring positioned between a collar and said upper ring plate;

wherein a position of said collar is adjustable along said length of said push rod and said collar may be selectively fixed and unfixed relative to said push rod, when unfixed said rod is movable through said collar in a linear direction relative to said collar, when fixed said rod is fixed in place relative to said collar in the linear direction when said rod is moved in said linear direction;

wherein when said collar is adjusted to a position on said rod to engage said spring and said collar is unfixed, said spring is uncompressed during linear travel of said push rod through said guide tube in said linear direction, and when said collar is fixed, said spring compresses during said liner travel of said push rod through said guide tube in said linear direction; and wherein said O-rings engage said rod of said push rod assembly.

12. A method for attaching a vapor plate to a manhole of a tanker comprising:

setting a plate of said vapor plate on a top edge of a rim of a manhole of said tanker;

contacting a lower member of a push rod of a push rod assembly with a bottom edge of said rim of said manhole while said push rod extends through said plate and extends through a resistance mechanism;

displacing said lower member a distance up and away from said bottom edge and towards said top edge while said push rod extends through said plate and through said resistance mechanism with the resistance mechanism in a disabled position;

after said displacement and while said push rod extends through said plate and through said resistance mechanism, enabling said resistance mechanism to be loaded with force to clamp said plate to said top edge, wherein prior to the step of enabling said push rod extends through said plate and through said resistance mechanism and is disabled from being loadable with force to clamp said plate to said top edge;

pushing down on a spring of said resistance mechanism to load said mechanism with force to clamp said plate to said top edge; and providing said force with said resistance mechanism to clamp said plate to said top edge wherein a portion of said resistance mechanism is movable between an unfixed position and a fixed position, and wherein when said portion is unfixed, said mechanism is disabled from being loaded with force to clamp said plate.

13. The method of claim 12 wherein said step of enabling includes fixing the portion of said resistance mechanism to said push rod in a linear position relative to said push rod during displacement of said push rod in the linear direction.

14. The method of claim 13 wherein said setting said plate on said top edge of said rim of a manhole step further comprises rotating a top handle of said push rod so that said top handle extends inward relative to a center of said plate, wherein said top and lower handles are timed thereby resulting in both handles facing inward.

* * * * *